US009153897B2

(12) United States Patent
Chen et al.

(10) Patent No.: US 9,153,897 B2
(45) Date of Patent: Oct. 6, 2015

(54) MAG-JACK MODULE

(75) Inventors: Johnny Chen, Danville, CA (US); Brian P. O'Malley, Naperville, IL (US); Eliza L. Conant, Beijing (CN)

(73) Assignee: Molex, LLC, Lisle, IL (US)

( * ) Notice: Subject to any disclaimer, the term of this patent is extended or adjusted under 35 U.S.C. 154(b) by 330 days.

(21) Appl. No.: 13/508,403

(22) PCT Filed: Nov. 4, 2010

(86) PCT No.: PCT/US2010/055443
§ 371 (c)(1),
(2), (4) Date: Aug. 28, 2012

(87) PCT Pub. No.: WO2011/056970
PCT Pub. Date: May 12, 2011

(65) Prior Publication Data

US 2012/0315794 A1 Dec. 13, 2012

Related U.S. Application Data

(60) Provisional application No. 61/259,083, filed on Nov. 6, 2009.

(51) Int. Cl.

| | |
|---|---|
| ***H01H 13/66*** | (2006.01) |
| ***H01R 13/514*** | (2006.01) |
| ***H01R 13/66*** | (2006.01) |
| ***H01R 24/64*** | (2011.01) |

(52) U.S. Cl.
CPC ..... *H01R 13/514* (2013.01); *H01R 13/6633* (2013.01); *H01R 13/6658* (2013.01); *H01R 24/64* (2013.01)

(58) Field of Classification Search
CPC ..... H01R 13/514; H01R 13/6633; H01R 13/6658; H01R 24/64
USPC ..... 439/620.07, 620.15–620.19, 439/620.21–620.23
See application file for complete search history.

(56) References Cited

U.S. PATENT DOCUMENTS

| | | | |
|---|---|---|---|
| 6,159,039 | A | 12/2000 | Wu |
| 6,162,089 | A | 12/2000 | Costello et al. |
| 6,206,725 | B1 | 3/2001 | Wu |
| 6,302,741 | B1 | 10/2001 | Fasold et al. |
| 6,511,348 | B1 | 1/2003 | Wojtacki et al. |
| 6,537,110 | B1 | 3/2003 | Korsunsky et al. |
| 6,612,871 | B1 | 9/2003 | Givens |
| 6,641,440 | B1 | 11/2003 | Hyland et al. |
| 6,655,988 | B1 | 12/2003 | Simmons et al. |

(Continued)

FOREIGN PATENT DOCUMENTS

KR 2003-0043743 A 6/2003

OTHER PUBLICATIONS

International Search Report for PCT/US2010/055443.

*Primary Examiner* — Felix O Figueroa
(74) *Attorney, Agent, or Firm* — Stephen L. Sheldon

(57) ABSTRACT

A connector with a port is provided that includes a first and second terminal, the first and second terminal configured to function as a differential pair and receive a differential signal. The differential pair is coupled a conditioning module. The conditioning module can be configured to provide an improved transformer. A common-mode circuit can be used to determine a level of common mode energy on the differential pair so as to provide feedback to an associated ASIC.

3 Claims, 9 Drawing Sheets

(56) References Cited

U.S. PATENT DOCUMENTS

| | | | | |
|---|---|---|---|---|
| 6,659,807 | B1 | 12/2003 | Zheng et al. | |
| 6,695,646 | B1 | 2/2004 | Grabbe | |
| 6,699,071 | B1 | 3/2004 | Hyland | |
| 6,702,610 | B2 | 3/2004 | Zheng et al. | |
| 6,736,673 | B1 | 5/2004 | Simmons et al. | |
| 6,743,047 | B2 | 6/2004 | Korsunsky et al. | |
| 6,817,890 | B1 | 11/2004 | Schindler | |
| 6,962,511 | B2 | 11/2005 | Gutierrez et al. | |
| 7,033,210 | B1 | 4/2006 | Laurer et al. | |
| 7,241,181 | B2 | 7/2007 | Machado et al. | |
| 7,309,260 | B2 * | 12/2007 | Brower et al. | 439/676 |
| 7,670,183 | B2 | 3/2010 | Huang et al. | |
| 7,674,136 | B2 | 3/2010 | Steinke et al. | |
| 7,712,941 | B2 | 5/2010 | Tai et al. | |
| 8,284,007 | B1 | 10/2012 | Langner et al. | |
| 8,333,599 | B2 * | 12/2012 | Xu et al. | 439/76.1 |
| 2004/0002258 | A1 | 1/2004 | Zheng et al. | |
| 2005/0255746 | A1 | 11/2005 | Hyland | |
| 2006/0030221 | A1 | 2/2006 | Hyland et al. | |
| 2009/0098766 | A1 | 4/2009 | Steinke et al. | |
| 2009/0253293 | A1 | 10/2009 | Zhang | |
| 2010/0015852 | A1 | 1/2010 | Xu et al. | |

* cited by examiner

MAG-JACK MODULE

CROSS-REFERENCE TO RELATED APPLICATIONS

This application is a national phase of PCT Application No. PCT/US2010/055443, filed Nov. 4, 2010, which in turn claims priority to U.S. Provisional No. 61/259,083, filed Nov. 6, 2009, which is incorporated herein by reference in its entirety.

BACKGROUND

1. Field of the Invention

The present invention relates to the field of connectors suitable for use in data communication, more specifically to connectors that include signal conditioning.

2. Description of Related Art

As is known, a connector with a receptacle configured to receive a plug connector mounted on the end of a cable can be provided. One popular configuration is the receptacle (or port) configured to receive an eight position eight contact (8P8C) module plug. It is noted that the 8P8C plug is often referred to as an RJ45 plug connector (even if the 8P8C plug technically may not be a true RJ45 connector). For purpose of being compatible with popular usage, therefore, this known interface will be referred to as a RJ45 interface herein.

The typical RJ45 receptacle provides what is referred to as a port (or jack) that is sized to receive the RJ45 plug in a desired orientation and include eight (8) terminals for engagement with the eight contacts in the RJ45 plug. The RJ45 plug is mounted on one end of a cable that includes multiple pairs of twisted wires (e.g., twisted pair) and each twisted pair can be used to provide a differential signal channel while being reasonably resisting to spurious signals, thus providing reasonably good performance even with unshielded cables. Therefore, the RJ45 connectors and twisted pair cables have formed a useful part of the network of many communication systems and are popular in wired Ethernet networks used in many homes and businesses throughout the world.

While earlier versions of the communication systems that use the RJ45 connector used two pair twisted pair (e.g., pair 4/5 and pair 3/6) to provide speeds up to 100 Mbps, recent communication systems have begun to provide 1 Gbps or even 10 Gbps data rates and therefore tend to use all four (4) of the twisted pairs provided in category 5 and category 6 cables. Even with the additional pairs, however, the desire for increased data rates has required higher frequencies and increased PAM levels (10 Gbps uses PAM-16 encoding at 650 Mhz, for example). This has led to the need to reduced operating lengths of the cable when using conventional RJ45 connectors in combination with conventional Category 5 cabling. Some have suggested that improved cabling (such as Category 6a or even Category 7 cabling) would help solve this issue. However, for individuals with cables already installed, rerunning cabling is less desirable.

One potential aid is to use an improved port or jack. One design configured to improve the performance of the jack has been to use a signaling module associated with each pair of terminals. The signaling module can include a transformer to magnetically couple the ASIC to the terminals while providing electrical isolation and the signaling module can also include a choke configured to reduce common-mode energy that might be otherwise carried over the differential pair. These jacks, because the transformer and choke use magnetic material, are often known as mag-jacks. Existing designs of mag-jacks, however, may not be sufficient to address system needs. Therefore, certain individuals would appreciate improvements to mag-jacks.

BRIEF SUMMARY

A connector with a port is provided. The port includes a first and second terminal, the first and second terminal configured to receive a differential signal. The first and second terminal are coupled a conditioning module. The conditioning module includes a first conductive member electrically connected to the first terminal and a second conductive member electrically connected to the second terminal. The first and second conductive member are magnetically coupled to a third and fourth conductive member via a transformer. One of the first and second conductive member and the third and fourth conductive member pass through a choke. The third and fourth conductive member are electrically connected to terminals that can be mounted on a circuit board so as to electrically connect the third and fourth conductive member to an ASIC. In an embodiment, the first and third conductive member are twisted together to form a first wire group and the second and fourth conductive member are twisted together to form a second wire group and the first and second wire group are wound through the transformer but the first and second wire group are not twisted together while being wound through the transformer. In an embodiment, the first, second, third, and fourth conductive member are each formed from two separate wires, which may be 40 gauge wires. In an embodiment, the first and second wire groups are formed as discussed above and each conductive member is formed from two separate wires and the wires may be 40 gauge wires. In an embodiment, a level of common mode energy on the differential pair can be sensed so as to provide feedback.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
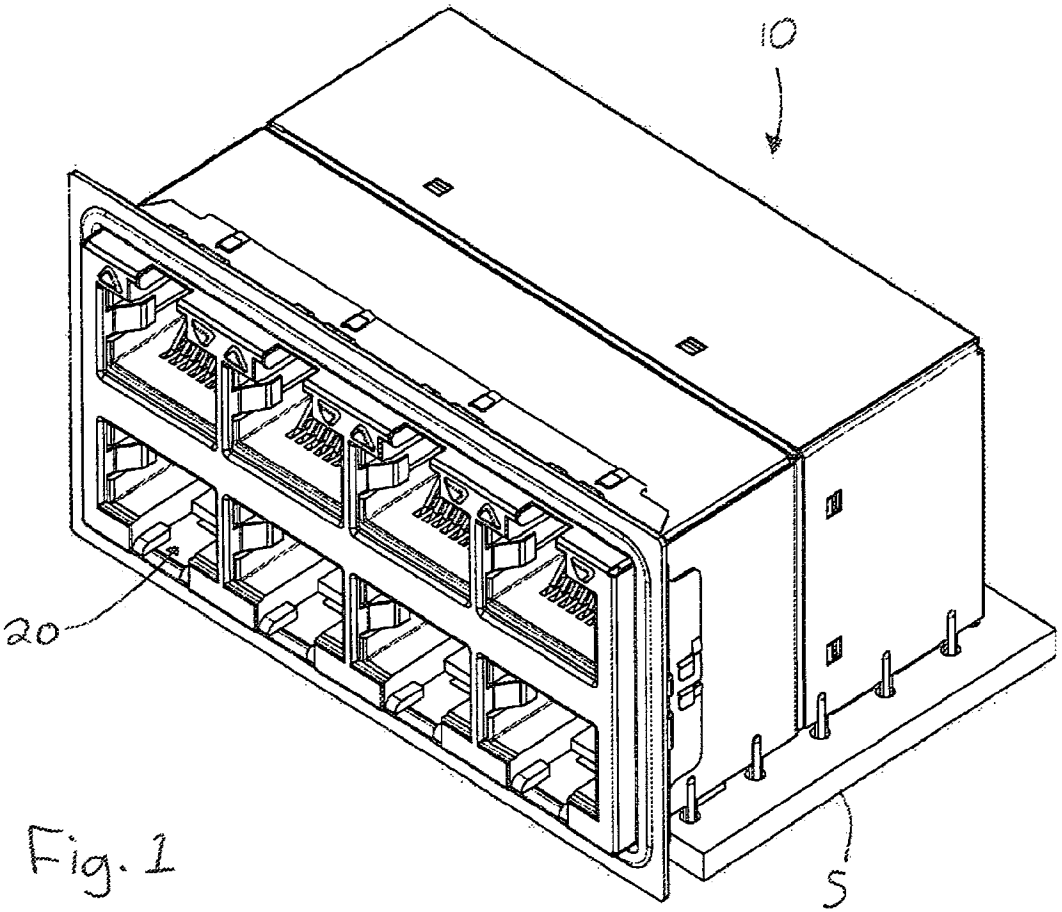
FIG. 1 illustrates a perspective view of an embodiment of ganged connector assembly.
Figure 2:
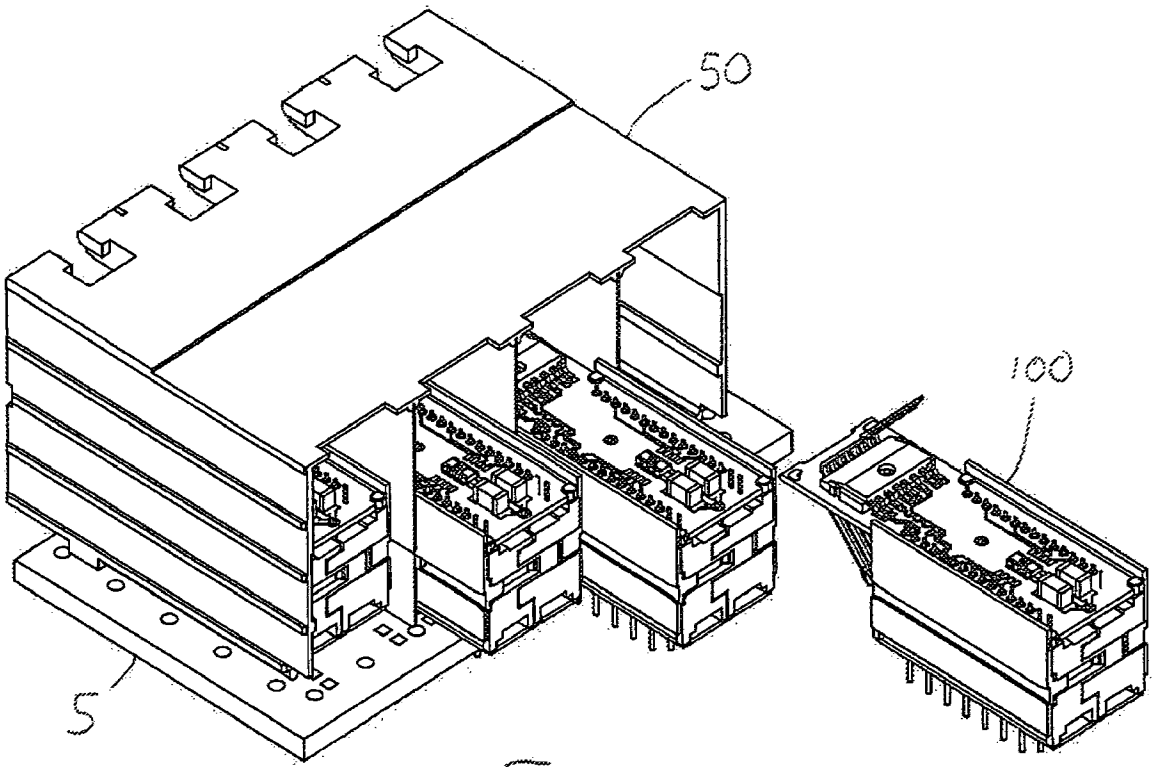
FIG. 2 illustrates a partially exploded perspective view of the ganged connector assembly of FIG. 1.
Figure 3:
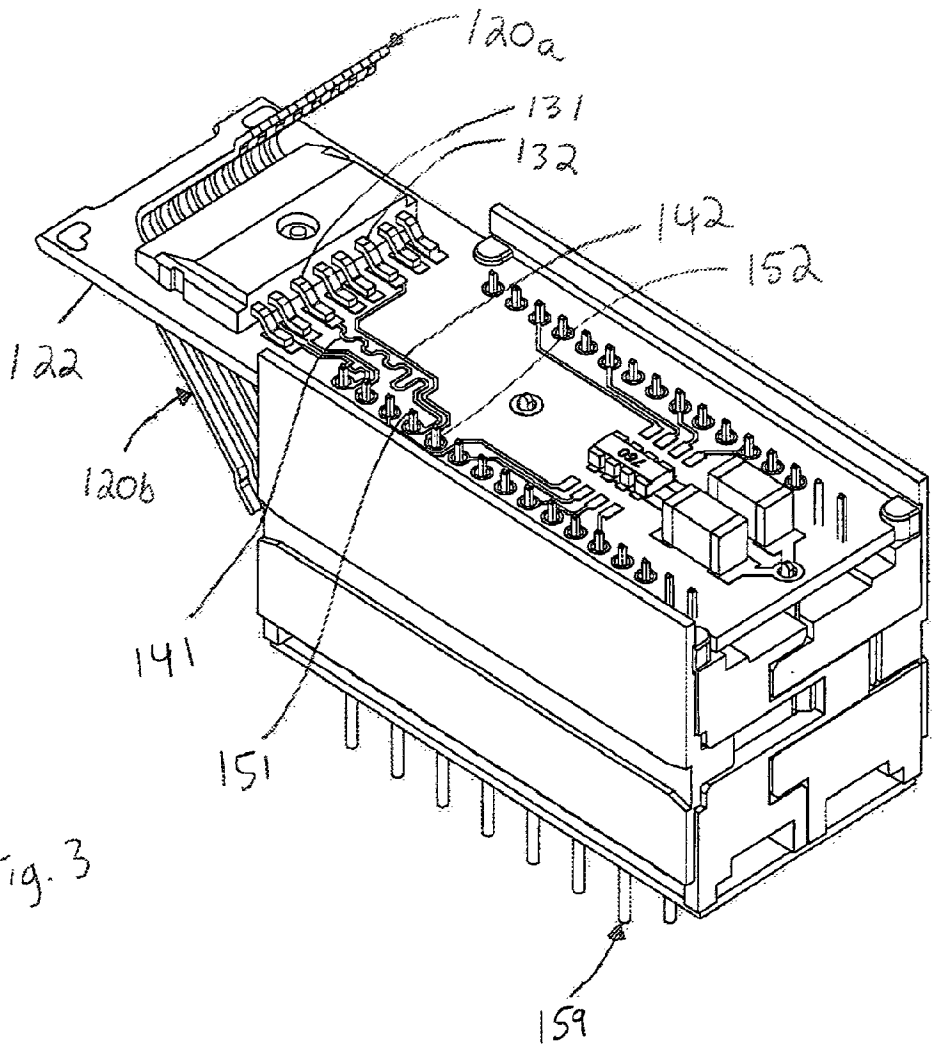
FIG. 3 illustrates a perspective view of an embodiment of a signal module.

FIGS. 1-3 illustrate an exemplary embodiment of a magjack system 10 mounted on a circuit board 5. A housing 50 is provides ports 20 and supports a plurality of signal modules 100. As depicted, 4 signal modules 100 are provided and each signal module 100 is configured to provide terminals and signal conditioning for two ports (which as depicted are positioned in a vertical arrangement with an opposite orientation). While the depicted configurations provides a number of manufacturing and use benefits, other configurations such as a single row of ports could also be provided. Thus, the depicted signal module 100 is merely exemplary.

As depicted, terminals arrays 120*a*, 120*b* are configured to be positioned in separate ports 20 and are supported by a circuit board 122. As is known, the terminal array can be broken down into pairs of terminals that together receive a differential signal (e.g., a differential pair). The depicted ports include 8 terminals that form four differential pair so as to correspond to the four twisted pair of wires in industry approved cabling. For example, terminal 131 and terminal 132 are configured to provide a differential pair (the split 3/6 pair driven by legacy concerns). Other configurations are possible and could be provided as desired. Traces 141, 142 extend from The terminals 131, 132 are electrically connected to pins 151, 152 via traces 141, 142 and as depicted, the traces 141, 142 can be configured to be substantially the same length so as to help minimize skew and decrease conversion of common-mode energy to differential-mode energy. The pins 151, 152 are coupled to pins 159 (typically through a transformer) and pins 159 can be mounted into a supporting circuit board and routed to the appropriate components on the circuit board (e.g., an ASIC). As can be appreciated, signal module 100 is configured to provide an upper and lower port but could also be configured to provide just one port.

Figure 4:
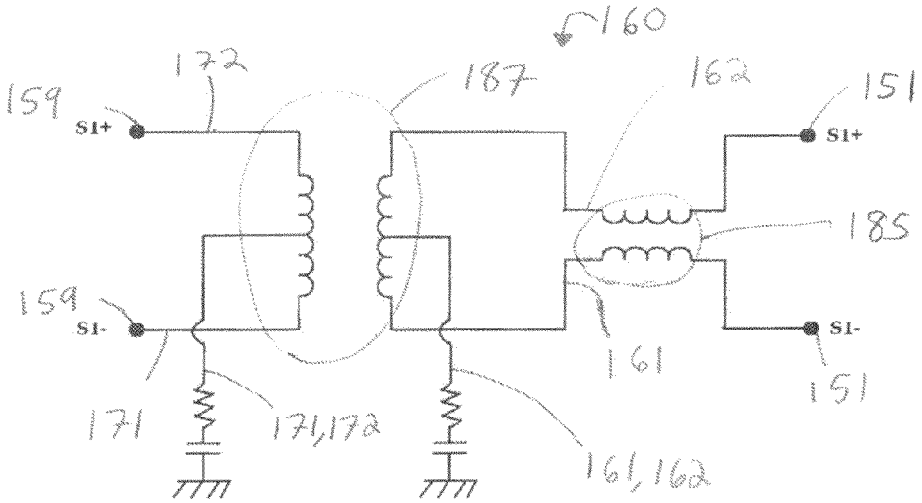
FIG. 4 illustrates a schematic of an embodiment of a conditioning module.
Figure 5:
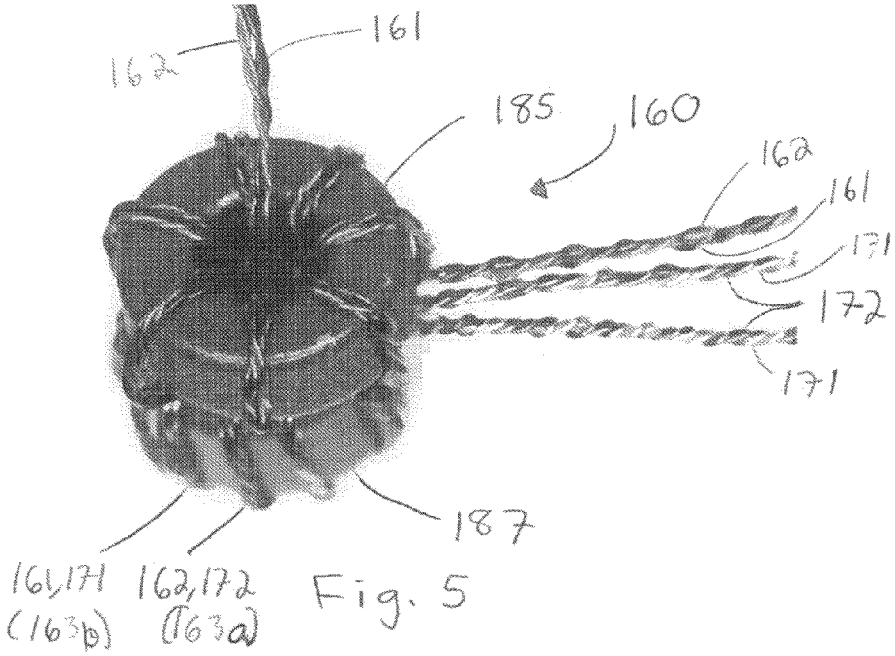
FIG. 5 illustrates a perspective view of an embodiment of a transformer and choke wound with conductive members.

FIG. 4 illustrates a schematic of a conditioning module 160 that includes a choke 185 and a transformer 187. Details regarding an embodiment of a conditioning module 160, including steps to produce such a conditioning module, are illustrated in FIGS. 5-10. A first conductive member 161 is coupled to a first pin 151 (which is in turn electrically connected to a first terminal that is configured to be positioned in a port). A second conductive member 162 is coupled a second pin 151 (which is in turn electrically connector to a second terminal that is configured to be positioned in a port). The first and second conductive member 161, 162, which form a differential signal pair, are wound through the choke 185 so as to help reduce common mode energy on the differential pair formed by the first and second conductive member 161, 162.

Then the first conductive member 161 is physically twisted with a third conductive member 171 to form a first wire group and wound through a transformer to magnetically couple the first and third conductive member together. Similarly, the second conductive member 162 is physically twisted with a fourth conductive member 172 and wound through the transformer to magnetically couple the second and fourth conductive member 162, 172 together. The third and fourth conductive member 171, 172 are then electrically connected to a third and fourth pin 159. The third and fourth pin 159 can be mounted on a circuit board so as to provide a communication path to an ASIC mounted on the circuit board (these components not being shown for purposes of brevity), as is known in the art.

It should be noted that as depicted, the first and third conductive member 161, 171 are twisted together separately from the second and fourth conductive member 162, 172 when they are wound through the transformer. Such a configuration has been determined to provide a benefit in that the capacitive coupling between the first and third conductive member is less affected by any unintentional capacitive coupling between the first conductive member and either the second and fourth conductive member. Similarly the third conductive member is also less affected by unintentional capacitive coupling between the third conductive member and the second and fourth conductive member. The second and fourth conductive member similarly benefit from this ability to reduce unintentional capacitive coupling.

Figure 6:
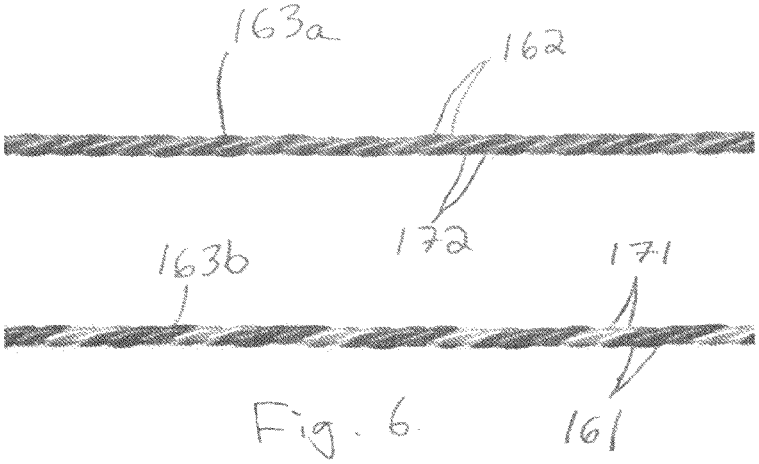
FIG. 6 illustrates a elevated front view of twisted pairs of conductive members.
Figure 7:
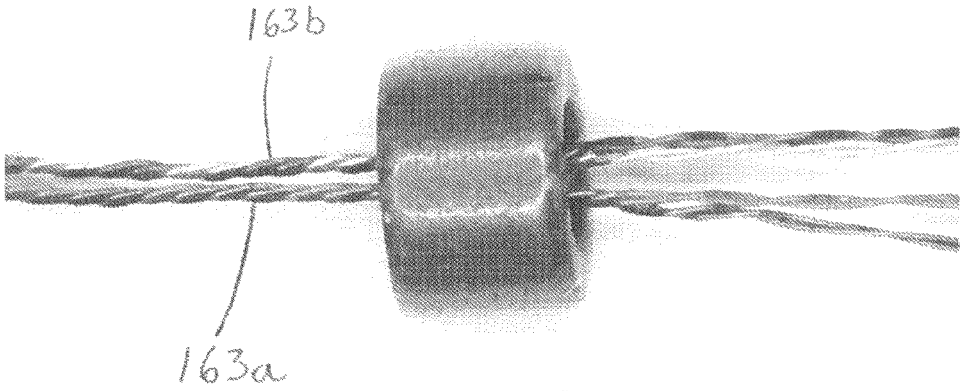
FIG. 7 illustrates a first step in a winding procedure for a transformer.
Figure 8:
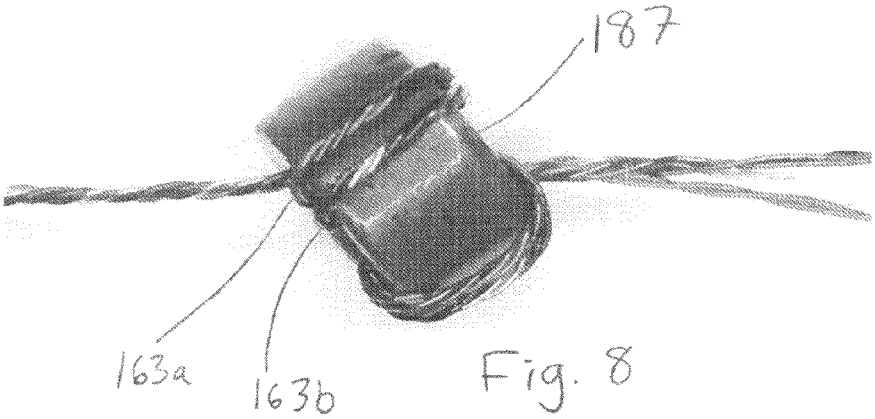
FIG. 8 illustrates the transformer depicted in FIG. 7 with several windings.
Figure 9:
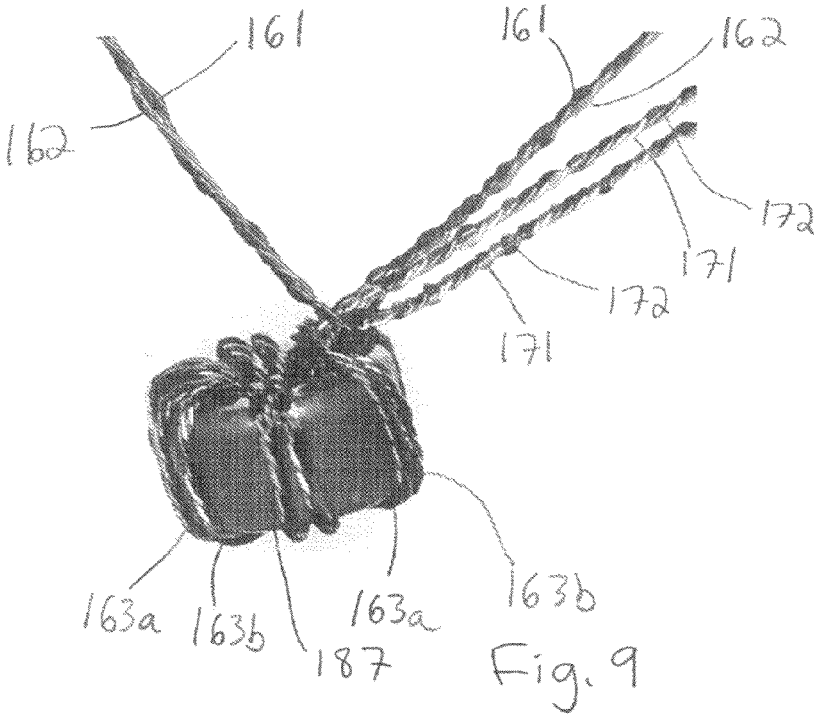
FIG. 9 illustrates the transformer depicted in FIG. 7 with a completed set of windings.
Figure 10:
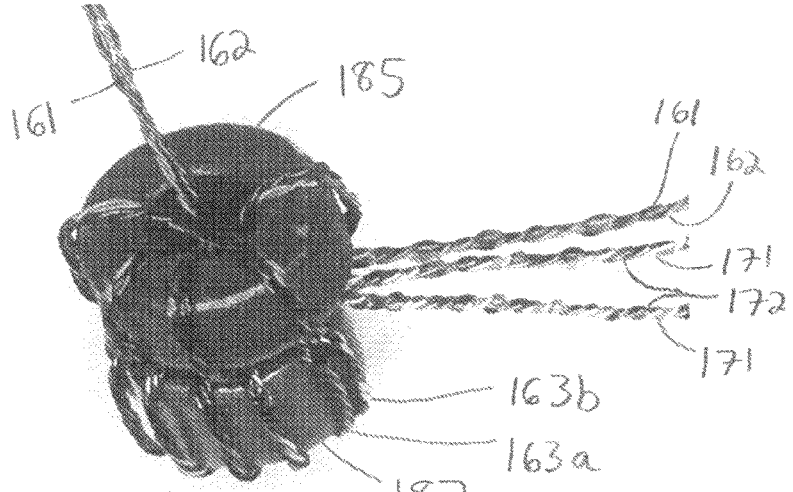
FIG. 10 illustrates the transformer depicted in FIG. 9 with a choke added and includes conductive members partially wound around the choke.

One feature that can be appreciated from FIG. 6 is that the conductive members 161, 162, 171, 172 are each formed from two individual wires. In an embodiment, a 34 gauge wire can be replaced with two 40 gauge wires. While the use of dual-wires is not required, it has been determined that such a configuration, somewhat surprisingly, provides better performance than using a single wire. Furthermore, it appears that the use of two 40 gauge wires appears to provide more consistent performance and increases robustness in the final assembly as compared to a single 34 gauge wire, even though the two wires increases the complexity of the design and the thinner wires would be expected to be less durable.

It should be noted that as depicted, both the separate wrapping and the dual-wire features are used in a conditioning module. Use of just one of these features without the other feature, however, is still beneficial.

In operation, as can be appreciated from FIGS. 6-10, the first and third and second and fourth conductive members are formed into a first and second wiring group 163*a*, 163*b* and then wound about the transformer 187. After exiting from the transformer 187, the first and second conductive members 161, 162 are twisted together, as are the third and fourth conductive members 171, 172. Preferably this takes place close to the edge of the transformer 187 (e.g., right after the final turn is completed) so as to ensure efficient transfer of the signal through the transformer 187. The first and second conductive members are then wound through the choke 185 and the conditioning module is ready for installation. This can be appreciated, a separate choke him transformer are used for each twisted-pair and the cable (e.g., each differential transmission line can be treated with the choke and transformer).

Figure 11:
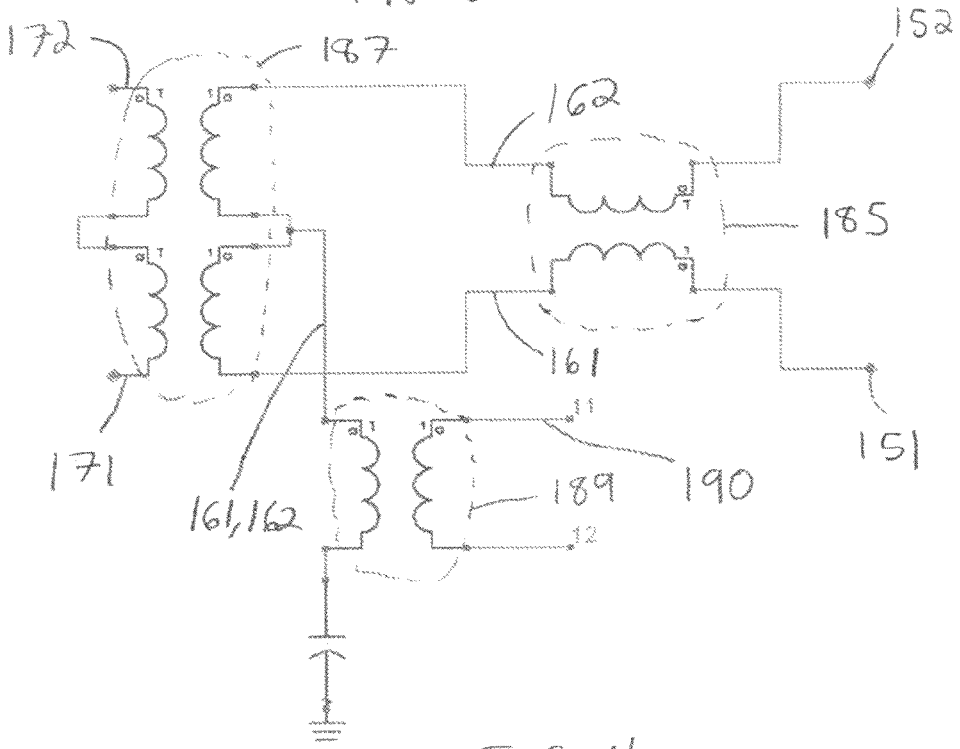
FIG. 11 illustrates a schematic representation of the embodiment depicted in FIG. 10 with the addition of a common-mode sensing circuit.
Figure 12:
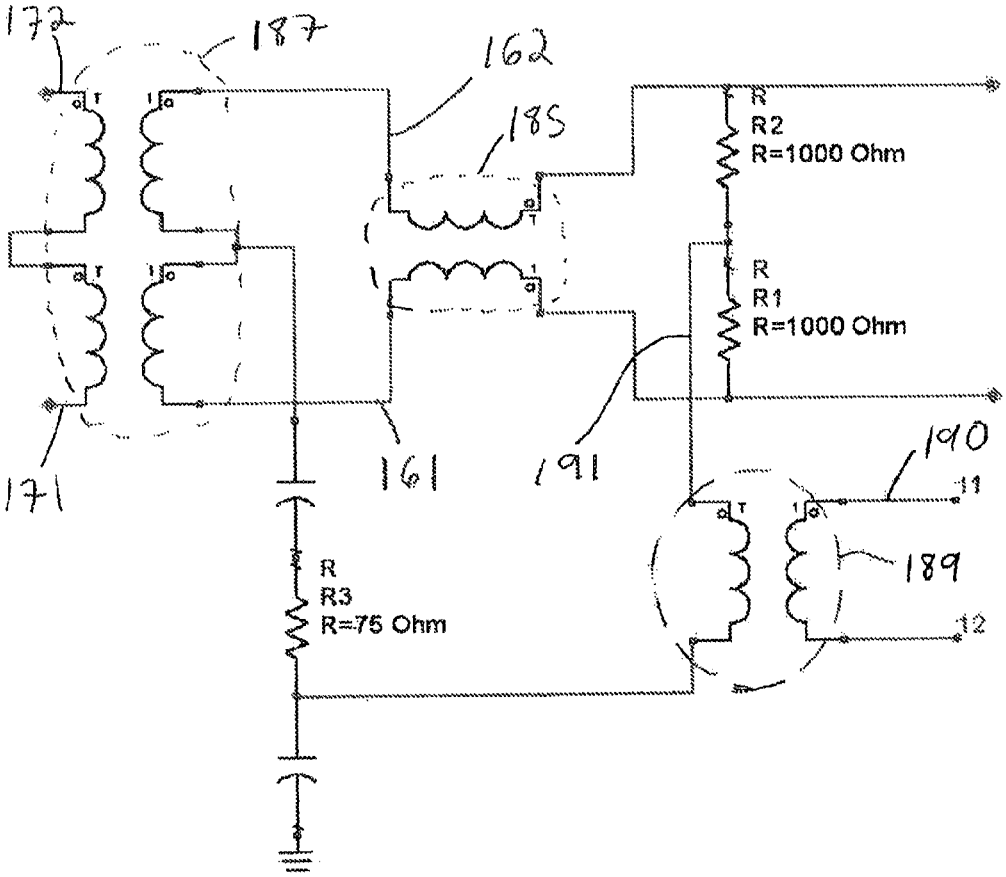
FIG. 12 illustrates a schematic representation of an alternative embodiment that includes a common-mode sensing circuit.
Figure 13:
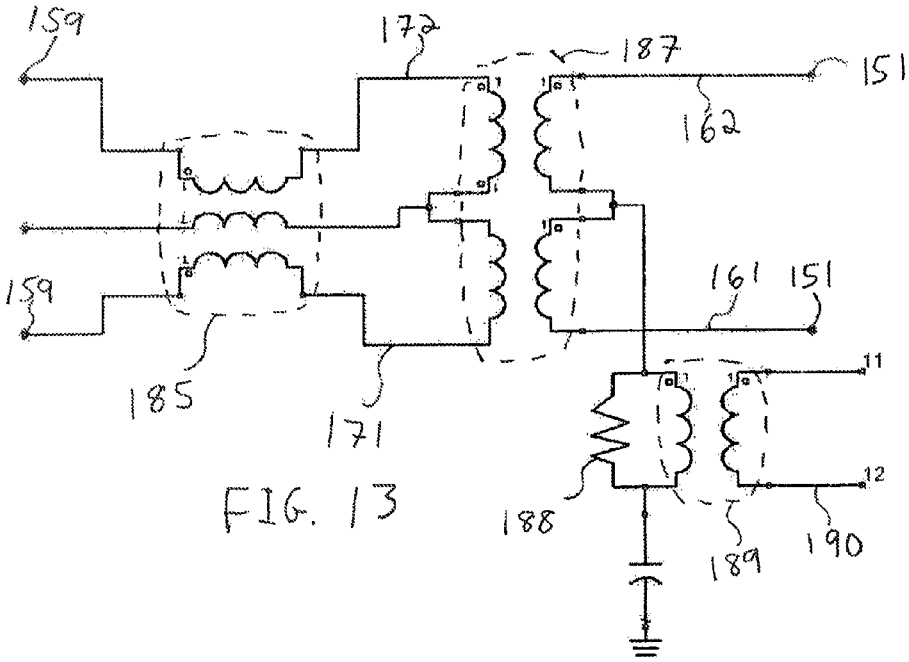
FIG. 13 illustrates a schematic representation of an alternative embodiment that includes a common-mode sensing circuit.

As noted above, the choke 185 is used to help filter out common mode energy. The choke is typically configured so that it will not become saturated because once saturated it essentially ceases to function. As can be appreciated, however, increasing the effectiveness of a choke tends to cause a reduction in the signal level that passes through the choke, thus the performance of the choke is typically balanced to provide an acceptable level of common mode energy reduction. Consequentially, it can be expected that some level of common mode energy will pass through the choke. Sometimes it is beneficial for the system to receive feedback regarding the amount of common mode energy on the differential pair, either before or after the choke. FIGS. 11-13 illustrate, in schematic form, embodiments that allow such feedback to be provided. Each function similarly in that a transformer 189, which may be configured similar to the transformer 187, couples a conductive element 190 to a conductive element 191 or both conductive elements 161 and 162 (which in that case the conductive elements can be electrically connected together so as to function as a centertap). The difference is that embodiments is that as depicted in FIG. 11, the common-mode sensing circuit provides feedback regarding the common mode energy that passes through the choke. In contrast, the embodiments in FIGS. 12 and 13 provide feedback on the common mode energy that is on the differential pair before the choke (FIG. 13 has a choke on the chip side of the transformer instead of the line side).

If the separate conductive element 191 shown in FIG. 12 is used, it can be placed between two matched resistors. While it is preferable that the two resistors be identical, in practice the resistors will have some tolerance but generally can be configured to provide a reasonable accurate indication of the common mode energy on the differential pair. It should be noted that while 1000 ohm resistors are depicted, other values may also be used. In general, it is desirable that the resistors are configured to ensure that less than 20 percent of the current will flow across the two resistors between the differential pair formed by the conductive members 161, 162.

Regardless of whether the configuration in FIG. 11 or 12 is used, the conductive member 190 can provide feedback to an ASIC that elevated common mode energy is present on the differential pair. For cables that don't include shielding, feedback of the common mode energy on one differential pair is expected to be sufficient to provide a reasonable indication of the common mode energy on the other differential pair. This feedback can be used by the ASIC to determine whether additional processing is needed to resolve the signal from noise and spurious signals. When the common mode energy is at an acceptable level, however, it may be possible to reduce the amount of processing required, thus reducing power requirements and/or the need for dissipation of thermal energy generated by a digital signal processor (DSP). In a system with a separate DSP for each port, avoiding the use of a substantial percentage of the DSPs can make a noticeable reduction in the amount of energy needed to operate the system.

As noted above, and as can be appreciated from FIG. 13, the choke 185 can be positioned on the chip side of the transformer rather than on the line side. This type of configuration could also be applied to the embodiments discussed above with respect to FIGS. 4-10. As can be appreciated, locating the choke chip side can be accomplished by electrically connecting the opposite sides of the conditioning module 160 to the pins 151, 159. Having the choke positioned on the chip side as shown in FIG. 13 allows the common mode energy to be sensed before the choke while still avoiding the need for the resistors. Thus, for systems where it is suitable to place the choke on the chip side, the embodiment schematically depicted in FIG. 13 may be desirable.

It should be noted that the transformer 189 is in parallel with a resistor 188 in FIG. 13. The same configuration could also be used in FIGS. 11 and 12 in the resistor 188 could have a value, without limitation, of about 50 to 200 ohms.

Figure 14:
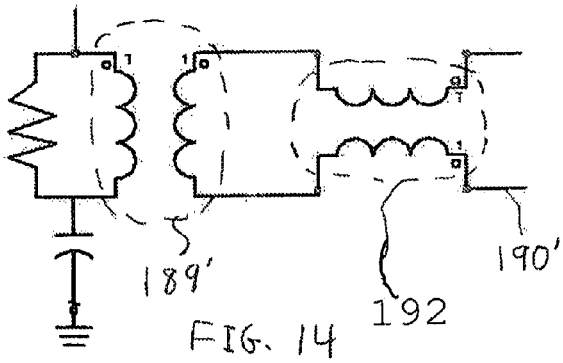
FIG. 14 illustrates an alternative embodiment of a common-mode sensing circuit.

FIG. 14 illustrates a further embodiment of a common-mode sensing circuit that includes a choke 192 before the conductive element 190' so as to provide optional EMI processing/reduction. As can be appreciated, the additional filtering can be provided on a supporting circuit board and need not be included directly in the signal module 100.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a housing, the housing including a port configured to receive a plug connector;

a first and second terminal positioned in the port;

a first and second pin electrically coupled, respectively, to the first and second terminal;

a third and fourth pin;

a conditioning module including a transformer and a choke, the conditioning module having a first and second conductive member coupled to the first pin and second pin and a third and fourth conductive member coupled to the third and fourth pin, the first and third conductive member coupled together to form a first wiring pair and the second and fourth conductive member coupled together to form a second wiring pair, the first and second wiring pair being separately wound through the transformer, the first and second conductive member being wound through the choke, wherein the transformer is a first transformer and the conditioning module includes a second transformer positioned on a line side, the second transformer configured to provide common mode energy sensing, wherein the second transformer is coupled to a centertap of the first transformer and the second transformer is coupled to two conductive members and a second choke is provided between the second transformer and the two conductive members.

2. A connector, comprising:

a housing, the housing including a port configured to receive a plug connector;

a first and second terminal positioned in the port;

a first and second pin electrically coupled, respectively, to the first and second terminal;

a third and fourth pin;

a conditioning module including a transformer and a choke, the conditioning module having a first and second conductive member coupled to the first pin and second pin and a third and fourth conductive member coupled to the third and fourth pin, the first and third conductive member coupled together to form a first wiring pair and the second and fourth conductive member coupled together to form a second wiring pair, the first and second wiring pair being separately wound through the transformer, the first and second conductive member being wound through the choke, wherein the transformer is a first transformer and the conditioning module includes a second transformer positioned on a line side, the second transformer configured to provide common mode energy sensing, wherein the second transformer is connected line side of the choke and is separated from the first and second conductive by two resistive elements and the second transformer is coupled to two conductive members and a second choke is provided between the second transformer and the two conductive members.

3. A connector, comprising:

a housing, the housing including a port configured to receive a plug connector;

a first and second terminal positioned in the port;

a first and second pin electrically coupled, respectively, to the first and second terminal;

a third and fourth pin;

a conditioning module including a transformer and a choke, the conditioning module having a first and second conductive member coupled to the first pin and second pin and a third and fourth conductive member coupled to the third and fourth pin, the first and third conductive member coupled together to form a first wiring pair and the second and fourth conductive member coupled together to form a second wiring pair, the first and second wiring pair being separately wound through the transformer, the first and second conductive member being wound through the choke, wherein the transformer is a first transformer and the conditioning module includes a second transformer positioned on a line side, the second transformer configured to provide common mode energy sensing, wherein the choke is positioned on a chip side of the first transformer and the second transformer is coupled to a centertap of the first transformer and the second transformer is coupled to two conductive members and a second choke is provided between the second transformer and the two conductive members.

* * * * *